United States Patent [19]

van Heel et al.

[11] 4,445,068

[45] Apr. 24, 1984

[54] LOW-PRESSURE MERCURY VAPOR DISCHARGE LAMP WITH INTERNAL GLASS FIBERS

[75] Inventors: Martinus J. M. van Heel; Petrus J. M. Willemsen, both of Roosendaal, Netherlands

[73] Assignee: U.S. Philips Corporation, New York, N.Y.

[21] Appl. No.: 452,341

[22] Filed: Dec. 22, 1982

Related U.S. Application Data

[63] Continuation of Ser. No. 205,067, Nov. 10, 1980, abandoned.

[30] Foreign Application Priority Data

Dec. 12, 1979 [NL] Netherlands ..... 7908924

[51] Int. Cl.[3] ..... H01J 5/16; H01J 61/067; H01J 61/44

[52] U.S. Cl. ..... 313/113; 313/608; 313/488

[58] Field of Search ..... 313/608, 484, 488, 113

[56] References Cited

U.S. PATENT DOCUMENTS 4,163,169 7/1979 Hasker ..... 313/608
4,179,777 12/1979 Hasker et al. ..... 313/608 X
4,221,988 9/1980 Hasker et al. ..... 313/608

*Primary Examiner*—Palmer C. Demeo
*Assistant Examiner*—Sandra L. O'Shea
*Attorney, Agent, or Firm*—Robert S. Smith

[57] ABSTRACT

The invention relates to a low-pressure mercury vapor discharge lamp having a tubular discharge vessel which is sealed in a vacuum-tight manner, a filamentary body, consisting for example of glass wool, which is thinly distributed over the volume of the discharge vessel being provided near the electrodes to increase the radiance in those portions of the discharge vessel.

2 Claims, 5 Drawing Figures

LOW-PRESSURE MERCURY VAPOR DISCHARGE LAMP WITH INTERNAL GLASS FIBERS

Figure 1:
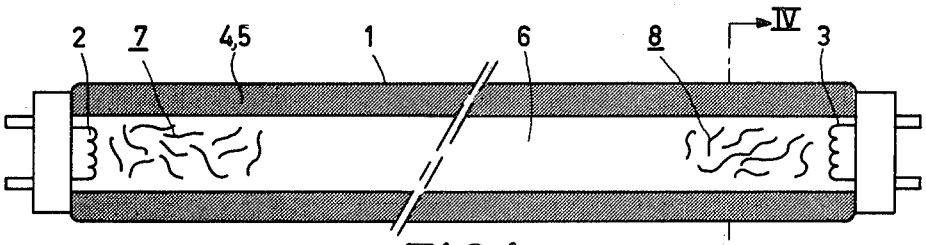

This is a continuation of application Ser. No. 205,067, filed Nov. 10, 1980, and now abandoned.

The invention relates to a low-pressure mercury vapor discharge lamp for reproduction purposes having a tubular discharge vessel which is sealed in a vacuum-tight manner, the vessel containing mercury and rare gas, electrodes between which a discharge takes place being located one at each end of the discharge vessel which further comprises a means to increase the radiance near the ends of the discharge vessel.

Such a lamp is disclosed in German Patent Specification No. 1,489,312.

Lamps of the above-described type find frequent application in reproduction or copying equipment. In addition to one or more of these lamps this equipment contains a support to be exposed to these lamps and on which an original to be copied on for example paper. The support consists of, for example, a glass plate which is adequately transmissive to the active radiation emitted by the lamp.

During copying it is desirable for the glass plate supporting the original to be irradiated such that the surface portions near the edges and the corners of a copy produced from the original are prevented from becoming darker owing to vignetting. In order to eliminate these undesired effects the above-mentioned German patent proposes to design a tubular lamp in which the radiance at its ends is greater than that in the center. Radiance should here be understood to mean the energy of the active radiation emitted by the lamp per unit of solid angle per unit of the surface of the radiation source per second.

The above-mentioned German patent describes a tubular low-pressure mercury vapor discharge lamp which is bent to a U-shape at some distance from the ends where the electrodes are disposed. In the region of the bent portion there is an indentation in the lamp which causes the cross sectional area of the lamp in that region to be smaller than the inside diameter of the other portions of the lamp. This achieves that the radiance at the indentations exceeds the radiance in the other portions of the lamp. When the radiance at the ends of the most important radiation producing portion of the lamp according to the German Patent Specification is increased, no special structural measures are required for this purpose in the copying device itself, such as, for example, the use of a mask of a special shape in front of an ordinary tubular lamp.

However, a drawback of the lamp described in the German Patent Specification is its expensive and complicated manufacture owing to the necessary bending and indenting procedure of the glass wall. Indenting the wall renders the lamp vulnerable to mechanical shock in that region. Besides that the radiance near the ends decreases in the long run as dust collects in the indentations at the outside of the lamp wall.

It is an object of the invention at least to mitigate these disadvantages by providing a low-pressure mercury vapor discharge lamp for reproduction purposes whose radiance at the ends is greater than in the other portions of the lamp.

According to the invention this object is accomplished with a low-pressure mercury vapor discharge lamp of the type defined in the opening paragraph and which is characterized in that the means for increasing the radiance near the ends of the discharge lamp comprises a respective thinly distributed body of filamentary material located in the discharge path near each electrode any further filamentary body that may be provided in the discharge path between the said bodies having a lower packing density than that of said portions.

The presence of the said body solely near the ends of the discharge vessel in the region of the electrodes has for its effect that the radiation output per unit volume of the lamp can be considerably increased. The body (having, for example, density limits as described in the U.S. Pat. No. 4,163,169) preferably extends over not more than one third of the electrode distance measured from each electrode.

Lamps according to the invention can be produced in a relatively simple manner and are less vulnerable to mechanical shock. In addition, they can be easily fitted in copying equipment as they are easily exchangeable for tubular lamps currently used in said equipment.

Lamps according to the invention do not only have the advantage of a high efficiency of the conversion of the electric power applied to the lamp into ultraviolet radiation but, also enable a lamp of a relatively short length to be obtained, so that they can even be used in relatively compact devices.

By means of lamps according to the invention an original to be copied can be so irradiated that the surface of a printed copy has hardly any dark portions.

A practical implementation of a thin-structured body in a lamp according to the invention may consist of glass wool which is thinly distributed over said portions of the discharge vessel, or the body may consist of a filamentary support extending in the longitudinal direction of the discharge vessel and glass fibers connected thereto which are evenly distributed along the volume of the discharge vessel and which extend substantially transversely of the support. (see for example U.S. Pat. No. 4,143,447.

In a special embodiment of a low-pressure mercury vapor discharge lamp according to the invention wherein a further body is present in the discharge path between the said first bodies, the packing density per unit volume of this body being less than the packing density of the said means. This embodiment has the advantage that, at a given applied lamp power, the losses in the stabilization element which is electrically connected to the lamp, and the losses at the electrodes are lower, because of the considerably lower required lamp current than is required in lamps not having such a body. In the lamps according to the invention the radiation output per unit of lamp volume is increased, but nevertheless is increased at the ends. The dimensions of the lamp can be considerably reduced. With a suitable choice of the packing density of one or more thin-structured bodies in the discharge vessel such a radiance of the radiation emitted by the lamp can be obtained that an image having a satisfactory quality is produced on the copy.

The invention can be used in many types of low-pressure mercury vapor discharge lamps for reproduction purposes. The inner side of the discharge vessel wall may be coated over its entire circumference with luminescent material, for example a luminescent material containing phosphors which are particularly suitable for this purpose, such as terbium-activated phosphors. In order to obtain a highly oriented radiation into the direction of the original, a longitudinal gap is often left in the luminescent layer of such lamps, through which a large portion of the generated radiation emerges to the environment. It is alternatively possible to further increase the light radiation by disposing a special reflective layer with longitudinal gap between the discharge vessel wall and the luminescent layer. Such a reflective layer consists, for example, of titanium dioxide.

Figure 2:
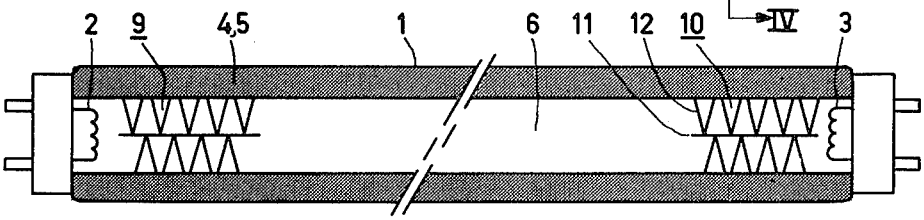
Figure 3:
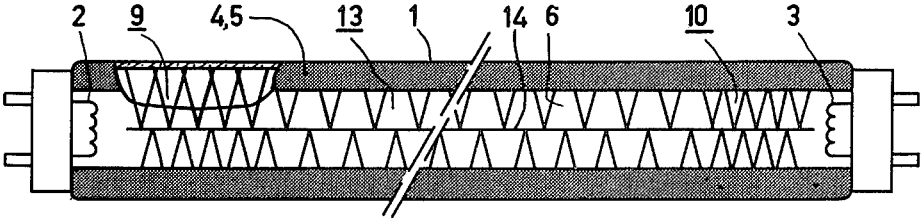
Figure 4:
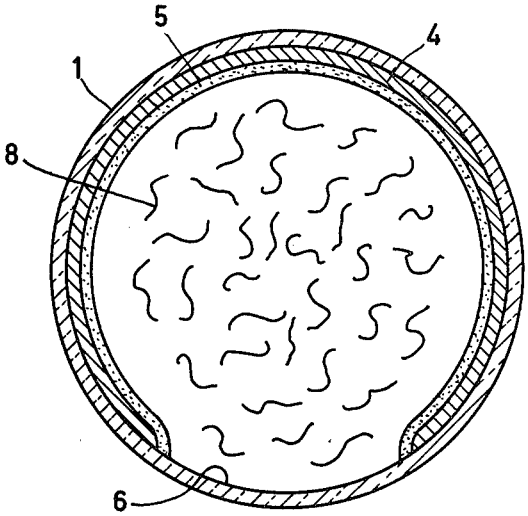
Figure 5:
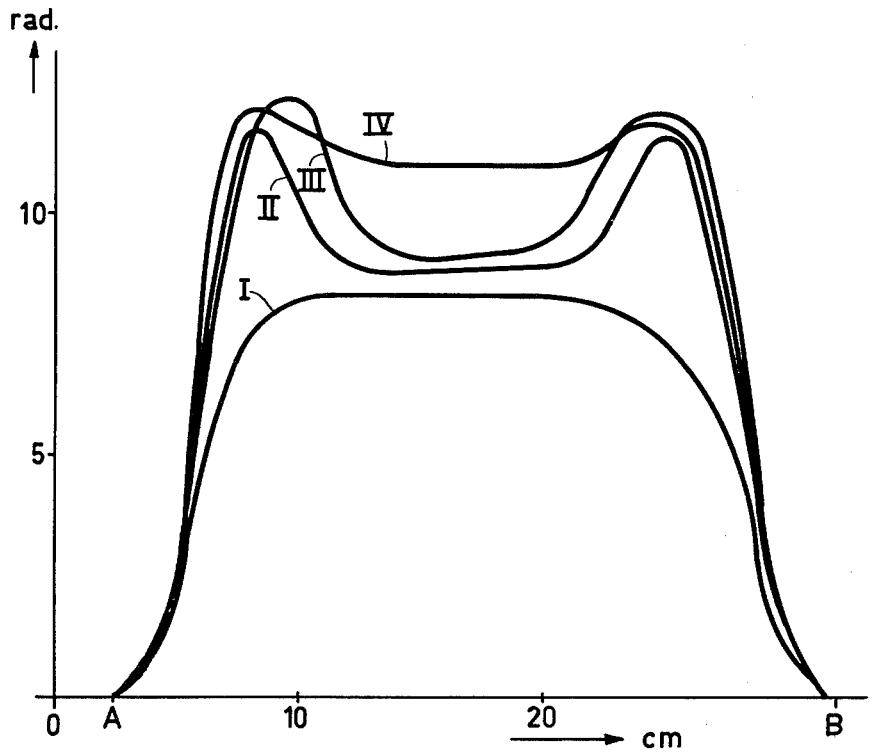

The invention will now be further explained with reference to the accompanying drawing which shows, by way of non-limitative example, a number of embodiments of a lamp according to the invention and a graph. In the drawings:

FIG. 1 is a schematic elevational view of a first embodiment of a lamp according to the invention and FIG. 2 is a schematic elevational view of a second embodiment of a lamp according to the invention, FIG. 3 is a schematic elevational view of a third embodiment of a lamp according to the invention, FIG. 4 shows an enlarged cross-sectional view along the plane IV—IV of the lamp shown in FIG. 1 and FIG. 5 is a graph which illustrates the variation of the radiance along the overall length of a number of lamps according to the invention, compared with a lamp which does not include the said means.

In the FIGS. 1 to 4 inclusive, reference numeral 1 denotes the glass wall of the tubular discharge vessel of a low-pressure mercury vapor discharge lamp for reproduction purposes according to the invention. Electrodes 2 and 3 are disposed one at each end of the discharge vessel. By means of these electrodes the discharge is generated in the discharge vessel which is filled with mercury vapor and one or more rare gases, as is customary for this type of lamp. A reflecting layer 4, consisting of fine-grained titanium dioxide, is applied on the inside of the glass wall 1. On the inside this layer is coated with a layer 5 consisting of luminescent material, for example, terbium-activated cerium magnesium aluminate.

A longitudinal gap 6 has been left in both the reflecting layer 4 and in the luminescent layer 5. In order to increase the radiance in the region of the electrodes in that portion of the discharge vessel through which the discharge passes during operation of the lamp, the lamp shown in FIG. 1 has been provided with a thinly distributed body of filamentary material consisting of glass wool, permeable to the discharge. These bodies are denoted by 7 and 8. The glass wool consists of, for example, filaments of gehlenite glass having a thickness of approximately 25 microns.

In the lamp shown in FIG. 2, the bodies 9 and 10 are disposed near the electrodes 2 and 3, respectively. These bodies consist of a filamentary longitudinal support 11 with glass fibers 12, connected thereto which are evenly distributed over the space within the discharge vessel and which extend substantially transversely to the support 11. The brush-like body may be produced by means of a method as described in U.S. Pat. No. 4,143,447.

In the embodiment of the lamp shown in FIG. 3 a further filamentary body 13 having the same shape as the bodies 9 and 10 is present in the discharge path between the bodies 9 and 10 already mentioned in the description of FIG. 2. The distance between the glass fibers of body 13 is, however, greater than that between the fibers of 9 and 10 (the packing density of 13 is lower). To simplify manufacture, the bodies 9, 10 and 13 have a common support wire 14 in one practical embodiment. This wire consists of, for example, a metal coated with a layer of glass enamel, by means of which the glass fibers are attached to the wire. The distance between the glass fibers in the region of the electrodes is approximately 2 to 3 times smaller than elsewhere.

A number of experiments were performed with lamps shown in FIG. 2 and in FIG. 3, as well as with lamps of the same dimensions but whose discharge vessel did not include a thin-structured, filamentary body the results of these experiments being shown in the graph of FIG. 5. The four curves shown in this graph correspond to four lamps I, II, III and IV of the same length (approximately 0.30 m.) and the same inside diameter (approximately 25 mm). The lamp length AB is plotted on the abscissa. The ordinate shows the radiance in any arbitory unit.

The lamps I to IV inclusive are operated in the same circumstances, this is to say the inside of the lamp wall was coated with a luminescent layer consisting of terbium-activated cerium magnesium aluminate. A reflecting layer consisting of $TiO_2$ was disposed between this layer and the glass wall. A longitudinal gap was left in the layers in a manner shown in the FIGS. 1 to 4, inclusive. In the lamps a quantity of argon was present at a pressure of 400 Pa, in addition to mercury vapor. In all cases the current intensity was 800 mA.

In the graph curve I corresponds to a lamp in which no measures to increase the radiance at the ends near the electrodes had been taken. The variation of the curve shows that the radiance decreases near the electrodes. The power consumed by this lamp was approximately 25 W. Curve II corresponds to a lamp shown in FIG. 2, in which thinly distributed body of filamentary material of a brush-like shape and having a length of 5 cm was present only in front of both electrodes. Curve III corresponds to a lamp shown in FIG. 2, the length of the brush-like body being, however, 7.5 cm. The variations of these curves II and III show that the radiance in the electrode region facing the discharge is considerably higher than in the said region of a lamp according to curve I. In addition, the radiance in the centre is also higher than in the center of a lamp according to the curve I. The power consumed by the lamps according to curves II and III was approximately 29 W. Finally, curve IV corresponds to a lamp as shown in FIG. 3. The brush-like body extends across the entire electrode distance AB. The mutual spacing between the fibers extending from the supporting wire is, however, different, depending on the position of said fibers the lamp space. The packing density of the fibers in the region of the electrodes (up to approximately 5 cm) is approximately 2.5 times larger than in the center of the lamp. By a suitable choice of the density differences the height of the relative maximum in the radiance curve can be varied. The consumed power of this lamp was 34 W.

What is claimed is:

1. A low-pressure mercury vapor discharge lamp for reproduction purposes having a tubular discharge vessel, said vessel having an inner wall on which is disposed a reflective layer in which a longitudinal gap is left, said vessel being sealed in a vacuum tight manner, said vessel containing mercury and rare gas, electrodes between which a discharge takes place being located at respective ends of said discharge vessel, said vessel further containing first and second thinly-distributed bodies of insulating filamentary material, said bodies being disposed proximate to each of said electrodes and collectively extending longitudinally over not more than one third of the distance intermediate said electrodes.

2. A low-pressure mercury vapor discharge lamp as claimed in claim 1, further including a third insulating filamentary body disposed in the discharge path between said first and second bodies, said third insulating filamentary body having a lower packing density than that of said first and second bodies.

* * * * *